United States Patent [19]

Candor

[11] 4,060,449

[45] * Nov. 29, 1977

[54] ELECTROSTATIC METHOD AND APPARATUS FOR MAKING A PATTERNED, NON-WOVEN SHEET

[76] Inventor: James T. Candor, 5440 Cynthia Lane, Dayton, Ohio 45429

[ * ] Notice: The portion of the term of this patent subsequent to Aug. 31, 1993, has been disclaimed.

[21] Appl. No.: 405,023

[22] Filed: Oct. 10, 1973

[51] Int. Cl.[2] ..... D21H 5/06

[52] U.S. Cl. ..... 162/109; 162/116; 162/192; 162/296; 204/300 R

[58] Field of Search ..... 162/109, 100, 192, 116, 162/296; 204/181, 300 R, 300 EC

[56] References Cited

U.S. PATENT DOCUMENTS

| | | | |
|---|---|---|---|
| 3,491,456 | 1/1970 | Candor et al. | 162/192 X |
| 3,705,847 | 12/1972 | Stiles | 204/181 |

*Primary Examiner*—Richard V. Fisher

*Attorney, Agent, or Firm*—Candor, Candor & Tassone

[57] ABSTRACT

A method and apparatus for making a patterned non-woven sheet by providing a slurry of fluid and fibers and forming the slurry into a sheet-like form. An electrostatic field action is provided that acts on the sheet-like form and causes the fibers to be arranged into a predetermined pattern whereby said patterned non-woven sheet is electrostatically formed.

20 Claims, 9 Drawing Figures

ELECTROSTATIC METHOD AND APPARATUS FOR MAKING A PATTERNED, NON-WOVEN SHEET

This invention relates to an improved method and apparatus for making a non-woven sheet and the like.

It is now well known from the U.S. Pat. to Stiles, No. 3,705,847, that a slurry of fluid and papermaking fibers can be passed between parallel adjacent runs of two continuous and looped conductive belt means which are charged to provide a potential differential therebetween and thereby cause the fibers in the slurry to form into a non-patterned, non-woven fiber mat on one of the belt means by an electrophoretic action while liquid is driven toward the other belt means by electro-osmosis so that the thus formed fiber mat can be transferred from its respective belt means to be further dried to form a dried sheet of paper or the like.

It is well known from the U.S. Pat. to Kalwaites, No. 2,862,251, that a slurry of fluid and natural or synthetic fibers can be formed into a continuous sheet in a conventional paper-making apparatus and before the resulting non-patterned fiber mat has been dried, jets of liquid can be forced through the fiber mat in combination with unique forming structure to cause the fibers in the fiber mat to be rearranged into a predetermined pattern comprising spaced interconnected packed fibrous portions with less dense or apertured portions therebetween whereby a patterned non-woven sheet is subsequently provided when the rearranged fiber mat is subsequently dried.

It is suggested in the U.S. Pat. to Candor et al, No. 3,757,426, and the various related U.S. Pats. referred to therein, that a slurry of fluid and paper-making fibers can be formed into a fibrous sheet by utilizing electrostatic means to remove liquid from such slurry during a paper-making operation or the like.

It is a feature of this invention to provide means for making a patterned non-woven sheet similar to the patterned sheets described in the aforementioned patent to Kalwaites by utilizing modified means of the aforementioned U.S. Pat. to Candor et al and Stiles.

In particular, one embodiment of this invention provides a method and apparatus for making a patterned non-woven sheet by providing a slurry of fluid and fibers and forming that slurry into a sheet-like form. An electrostatic field action is created to act on such sheet-like form and cause the fibers thereof to be arranged into a predetermined pattern whereby a patterned non-woven sheet is provided.

It is another feature of this invention to provide an improved apparatus and method for making a non-woven sheet, whether or not such non-woven sheet is a patterned non-woven sheet or an unpatterned non-woven sheet, by providing improved means of the aforementioned Candor et al and Stiles arrangements.

In particular, one embodiment of this invention provides a method and apparatus for making a non-woven sheet from a slurry of fluid and fibers by passing a sheet-like form of such slurry between insulating faces of a pair of spaced apart electrode means that provide an electrostatic field action therebetween that acts on the sheet-like form to assist in the making of the non-woven sheet.

Accordingly, it is an object of this invention to provide an improved method of making a non-woven sheet or the like, the method of this invention having one or more of the novel features set forth above or hereinafter shown or described.

Another object of this invention is to provide an improved apparatus for making a non-woven sheet or the like, the apparatus of this invention having one or more of the novel features set forth above or hereinafter shown or described.

Other objects, uses and advantages of this invention are apparent from a reading of this description, which proceeds with reference to the accompanying drawings forming a part thereof and wherein:

FIG. 2 is a schematic view illustrating the improved method and apparatus of this invention believed to be adapted to make the patterned non-woven sheet of FIG. 1 or the like.

Figure 3:
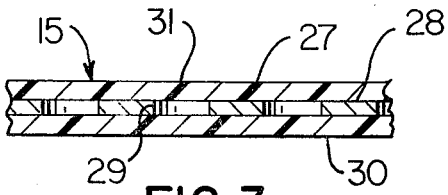
Figure 2:
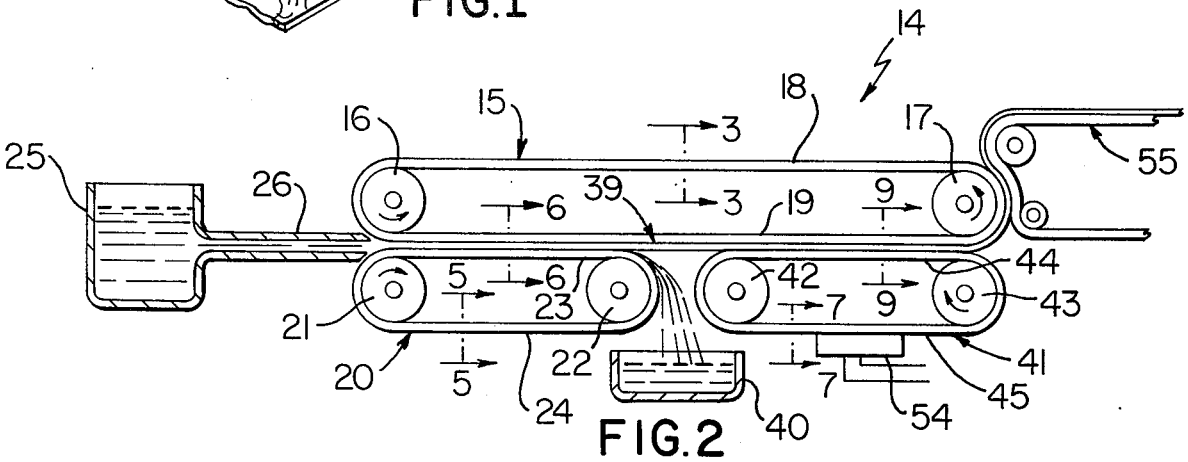

FIG. 3 is an enlarged, fragmentary, cross-sectional view taken on line 3—3 of FIG. 2 and illustrates the structure of the upper belt means of the apparatus of FIG. 2, FIG. 3 being turned 180° from the position taken on line 3—3 of FIG. 2.

Figure 4:
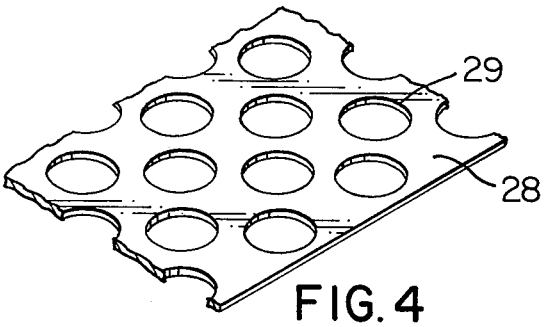

FIG. 4 is a fragmentary, perspective view illustrating the conductive electrode means of the belt means of FIG. 3.

Figure 5:
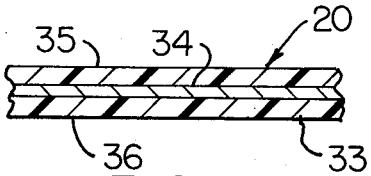

FIG. 5 is an enlarged, fragmentary, cross-sectional view taken on line 5—5 of FIG. 2 and illustrates a lower belt means of the apparatus of FIG. 2, FIG. 5 being turned 180° from the position taken on line 5—5 of FIG. 2.

Figure 7:
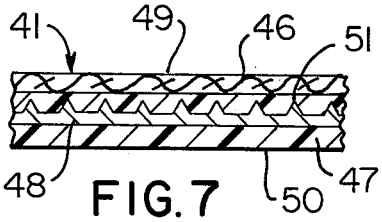
Figure 6:
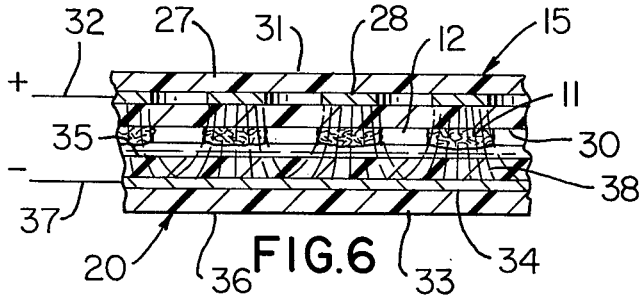

FIG. 6 is an enlarged, fragmentary, cross-sectional view taken on line 6—6 of FIG. 2 and illustrates how it is believed that the patterned non-woven sheet can be formed between the adjacent runs of the belt means of FIGS. 3 and 5. FIG. 7 is an enlarged, fragmentary, cross-sectional view taken on line 7—7 of FIG. 2 and illustrates another lower belt means of the apparatus of FIG. 2, FIG. 7 being turned 180° from the position taken on line 7—7 on FIG. 2.

Figure 8:
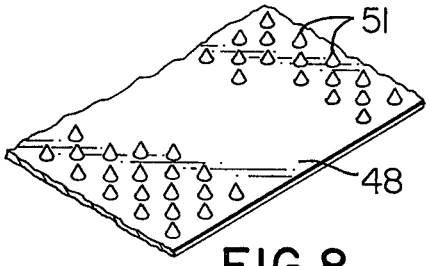

FIG. 8 is a fragmentary, perspective view illustrating the conductive member or electrode means of the belt means of FIG. 7.

Figure 9:
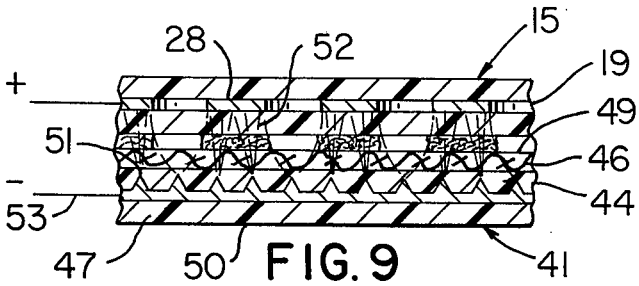

FIG. 9 is an enlarged, fragmentary, cross-sectional view taken on line 9—9 of FIG. 2 and illustrates how it is believed that the formed non-woven sheet of this invention will pass between the upper belt means of FIG. 3 and the lower belt means of FIG. 7.

While the various features of this invention are hereinafter described and illustrated as being particularly adapted to provide a non-woven sheet, it is to be understood that the various features of this invention can be utilized singly or in any combination thereof to provide other fibrous structures or the like as desired.

Therefore, this invention is not to be limited to only the embodiment illustrated in the drawings, because the drawings are merely utilized to illustrate one of the wide variety of uses of this invention.

Figure 1:
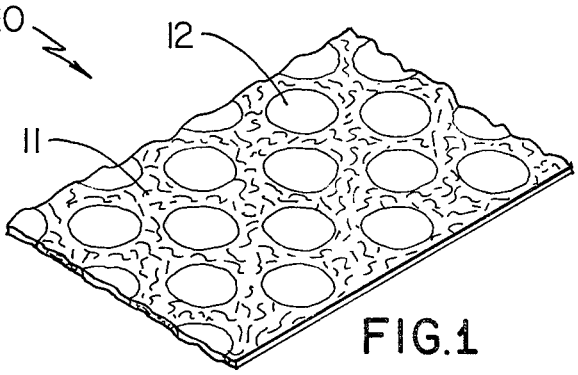
FIG. 1 is a fragmentary, perspective view illustrating a patterned non-woven sheet that is intended to be made by the method and apparatus of this invention.

Referring now to FIG. 1, a patterned non-woven structure is generally indicated by the reference numeral 10 and can comprise patterned areas 11 of interconnected bundles of fibers surrounding other patterned areas 12, the patterned areas 12 can either be somewhat uniformly arranged apertures passing through the sheet means 10 or be substantially uniformly arranged areas of fibers that are less dense than the density of the fibers in the other interconnected patterned areas 11.

As previously stated, the U.S. Patent to Kalwaites, No. 2,862,251, fully discloses how such patterned sheet 10 can be formed with the more dense areas 11 and the less dense areas 12 being arranged in various predetermined patterns by forcing jets of fluid through appropriately shaped apertured sheets and then through a non-patterned fiber mat to cause a rearranging of the fibers in such mat to provide the patterned arrangement of more dense areas 11 and less dense areas 12 whereby the resulting patterned sheet has the characteristic feel, hand and drape of conventional textile fabrics for similar uses.

The method and apparatus of this invention that is intended to form the non-woven sheet 10 of FIG. 1 is generally indicated by the reference numeral 14 in FIG. 2 and comprises an upper looped continuous belt means 15 passing around rollers 16 and 17 to define an upper run 18 and a lower run 19 thereof.

Another looped continuous belt means 20 of this invention is looped around rollers 21 and 22 to define an upper run 23 and a lower run 24 thereof whereby the upper run 23 of the lower belt 20 is disposed adjacent, but spaced from the lower run 19 of the upper belt means 15 to run substantially parallel therewith and be maintained uniformly spaced therefrom and have the side edges thereof sealed in the same manner as similar belt means in the aforementioned U.S. patent to Stiles, U.S. Pat. No. 3,705,847.

A slurry of the desired fluid and fibers, such as a liquid and paper making fibers, can be fed from a supply means 25 through a trough 26 to be fed in a continuous or intermitten sheet-like form between the adjacent runs 19 and 23 of the belt means 15 and 20 with such sheet-like form of slurry being uniformly provided by having the trough 26 vibrated in a suitable manner as provided in the aforementioned patent to Stiles.

The upper belt means 15 of this invention can be formed from flexible electrically insulating material 27, such as plastic material, having a flexible conductive sheet or electrode 28 embedded therein and being formed into a desired pattern such as by having a plurality of apertures 29 passing completely therethrough in a patterned arrangement as illustrated in FIG. 4 for a purpose hereinafter described.

The conductive sheet 28 of the belt means 15 is thus electrically insulated from the opposed faces 30 and 31 thereof and can be appropriately charged at the side edges of the belt means 15 in any suitable manner, such side edge charging of the belt means 15 being provided by the lead means 32 schematically illustrated in FIG. 6 and charging the conductive sheet 28 with a positive charge for a purpose hereinafter described.

While one form of a patterned conductive sheet 28 for the belt means 15 is illustrated in FIG. 4, it is to be understood that other forms of patterned conductive sheets can be utilized to provide a patterned non-woven sheet in the manner hereinafter described. For example, such patterned conductive sheet can actually comprise a wire screen, grill, etc., as the particular shape of the patterned areas 11 and 12 of the non-woven sheet 10 do not form the novel features of this invention as one of the novel features of this invention is to provide a non-woven sheet with any desired patterned areas.

The lower belt means 20 of this invention is best illustrated in FIG. 5 and also comprises a flexible sheet of electrically insulating material 33 also having a conductive sheet or electrode 34 embedded therein so as to be electrically insulated from opposed faces 35 and 36 of the belt means 20 while being adapted to be provided with a charge at the side edges thereof as illustrated schematically in FIG. 6 wherein a lead means 37 is illustrated as charging the conductive sheet 34 with a negative charge for a purpose hereinafter described.

While the conductive sheet 34 of the lower belt means 20 is illustrated as being continuous throughout and non-patterned, it is to be understood that the conductive sheet 34 could be also patterned in the same manner or in any desired different manner than the conductive sheet 28 of the upper belt means 15 in order to produce a desired electrostatic field action therewith which will produce a patterned non-woven sheet of the desired pattern as hereinafter described.

In any event, it can be seen that when the upper belt 15 is driven in a counterclockwise direction and the lower belt 20 is driven in a clockwise direction so that the adjacent runs 19 and 23 thereof continuously move from left to right in FIG. 2 at substantially the same speed, the slurry of fluid and fibers being fed from the supply means 25 through the trough 26 to the adjacent runs 19 and 23 of the belts 15 and 20 enters the same in a sheet-like form in a continuous manner and it is believed that the electrostatic field generated between the oppositely charged conductive sheets 28 and 34 of the belt means 15 and 20 will cause the fibers in the slurry between the runs 19 and 23 of the belt means 15 and 20 to form into a patterned non-woven mat against the surface 30 of the upper belt means 15 while the liquid in the slurry will be driven downwardly toward the surface 35 of the lower belt means 20 by the combined electrophoretic and electro-osmotic action of the electrostatic field on the slurry between the oppositely charged conductive sheets 28 and 34 which causes the fibers to move upwardly and the liquid to move downwardly as fully described in the aforementioned U.S. patent to Stiles.

However, according to the teachings of this invention, no electrical current flow takes place between the conductive layers 28 and 34 of the belt means 15 and 20 as the same are respectively insulated from the slurry disposed therebetween and it is believed that the electrostatic field action still functions in the same manner as in the patent to Stiles to drive the fibers upwardly and the liquid downwardly, so that a fiber mat is formed against the lower surface 30 of the lower run 19 of the upper belt means 15.

However, because the conductive sheet 28 of the upper belt means 15 of this invention is formed in a predetermined pattern, it is believed that such patterned conductive sheet 28 will cooperate with the lower conductive sheet 34 of the lower belt means 23 to create a plurality of nonuniform electrostatic fields that are generally indicated by the reference numeral 38 in FIG. 6 to cause the fibers to be formed against the surface 30 of the upper belt means 15 in a patterned arrangement of more dense interconnected fiber bundles 11 adjacent the non-perforated portions of the conductive sheet 28 while the fibers of the slurry will form adjacent the perforated parts 29 of the conductor sheet 28 with a pattern either of areas 12 of no fibers or of fibers less dense than the fibers in its interconnected areas 11 since it is well known that the more intense portion of a non-uniform field is stronger than a less intense portion of the non-uniform field so that the fibers will tend to form into the more dense bundles 11 adjacent the more intense portions of the fields 38 which are adjacent the unperforated parts of the conductive sheet 28 as illustrated in FIG. 6.

It is also believed that the liquid in the slurry between the runs 19 and 23 of the belts 15 and 20 will be driven downwardly even though it is toward the less intense portions of the non-uniform fields 38 because of the attraction of liquid for a negative charge which is on the conductive sheet 34. Also, the paper-making fibers have a tendency to be negatively charged and therefore tend to normally move toward the positively charged upper conductive sheet 28.

However, it is believed that there are times when there will be neutral fiber particles and the like in the slurry whereby the non-uniform fields will move such neutral particles toward the upper belt 15 through the action of the more intense parts of the non-uniform fields 38 tending to move neutral particles upwardly through the action of dieelectrophoresis whereby it is believed that all of the particles and fibers in the slurry will be utilized in forming the patterned mat against the belt 15.

Of course, if the lower belt means 20 has its conductive sheet 34 also provided with a pattern of conductive parts and non-conductive parts in a like manner or a different manner than the upper patterned conductive sheet 28, it is believed that the fibers will merely move upwardly where field actions are provided between the conductive parts of the upper and lower sheets 28 and 34, whether or not such fields are non-uniform or uniform, and will not move to any great extent into areas where no field action is taking place therebetween whereby it is believed that the resulting fiber mat against the upper belt 15 can be provided with the desired pattern through the patterned arrangement of either one or both of the upper and lower electrode means 28 and 34.

Therefore, it is believed that by the time the fiber mat passes beyond the upper run 23 of the lower belt 20 in the apparatus 14 illustrated in FIG. 2, the same has been formed into a sufficiently self-adhering patterned non-woven sheet form that is indicated by the reference numeral 39 in FIG. 2 to be further dried in its fiber arranged form in any suitable manner, the liquid from the slurry that has been removed from the fiber mat 39 by the electro-osmotic action of the fields 38 will flow off of the upper run 23 of the lower belt 20 as the same passes around the right-hand roller 22 to be received in a suitable reservoir 40 in the manner fully described in the aforementioned U.S. patent to Stiles, with such liquid being relatively free of fibers, etc., to be reused in processing more fibers for forming the slurry for the source 25.

Thus, the patterned non-woven mat 39 as it leaves the lower belt means 20 can be subsequently treated and dried in any desired manner, such as the manners set forth in the aforementioned U.S. patents to Kalwaites, Stiles and Candor et al.

However, if desired, the patterned non-woven sheet 39 can have at least some of the remaining liquid therein removed by another belt means of this invention that is generally indicated by the reference numeral 41 in FIGS. 2 and 7 and cooperates with the upper belt means 14 in a manner hereinafter described.

The continuous belt means 41 of this invention is looped around rollers 42 and 43 so as to provide an upper run 44 and a lower run 45 with the upper 44 being disposed substantially parallel to but spaced from the lower run 19 of the upper belt 15 so that when the lower belt means 41 is driven in a clockwise direction in FIG. 2 so as to have the upper run 44 running at substantially the same speed as the lower run 19 of the upper belt 15, the fiber mat 39 leaving the other lower belt means 20 will enter between the adjacent runs 44 and 19 of the belt means 41 and 15 to be carried from left to right therewith and have at least some of the liquid thereof removed by an electro-osmotic action as hereinafter described.

The belt means 41 is best illustrated in FIG. 7 and comprises a layer 46 of felt or other porous absorbing material attached to a flexible electrically insulating sheet 47 having a conductive sheet or electrode 48 embedded therein whereby the conductive sheet 48 is electrically insulated by the sheet 47 from the opposed faces 49 and 50 of the belt means 41 as well from the felt layer 46.

The electrode 48 can take any desired configuration and in the embodiment of this invention illustrated in the drawings, the conductive sheet 48 comprises a continuous conductive sheet having a plurality of conductive points 51 projecting upwardly therefrom toward the felt layer 46 with the points 51 being disposed in any desired pattern that will be cooperable with the unperforated portion of the conductive sheet 28 of the upper belt 15 to provide a plurality of non-uniform electrostatic fields that are generally indicated by the reference numeral 52 of FIG. 9 when the conductive sheet 48 is charged with a negative charge by a lead means 53 that is schematically illustrated in FIG. 9 so that the more intense portions of the non-uniform fields 52 will be directed downwardly into the felt layer 46 of the belt means 41 and thereby drive at least some of the retained moisture in the fibrous mat 39 downwardly into the felt layer 46 to be carried away by the felt layer 46 in the manner set forth in the aforementioned U.S. patents to Stiles and Candor et al.

The retained moisture that is now driven into the felt layer 46 of the belt 41 can be subsequently removed therefrom by having the lower run 45 of the belt 41 pass over a suction box means 54, FIG. 2, or any other suitable liquid-removing means.

The pattern of the points 51 of the conductive sheet 48 of the belt 41 can be so arranged relative to the unperforated portions of the conductive sheet 28 of the upper belt 15 that when the mat 39 passes between the adjacent runs 44 and 19 thereof in the manner illustrated in FIG. 9, a plurality of non-uniform fields will be extended through the more dense portions 11 of the mat 39 than the less dense portions 12 thereof for believed to be a better moisture removal operation.

Therefore, it can be seen that the method and apparatus 14 of this invention is readily adapted to take a slurry of fluid and fibers in sheet-like form and through the cooperation of the conductive layers 28 and 34 of the adjacent runs 19 and 23 of the belt means 15 and 20 to arrrange the fibers into a predetermined pattern by an electrophoretic action while removing some of the liquid therefrom by an electro-osmotic action so that a patterned fibrous mat 39 will be formed therefrom which can further have the retained moisture therein removed electro-osmotically by passing through the electrostatic field means 52 created between the conductive sheet 28 of the lower run 19 of the upper belt 15 and the conductive sheet 48 of the upper run 44 of the lower belt means 41 so that a more dried patterned non-woven mat 39 can be removed from the right-hand end of the belt means 15 by suitable take-off belt means 55 in the same manner as set forth in the aforementioned U.S. patent to Stiles for further treating and/or drying of the mat 39 by other electro-osmotic means or conventional drying means, as desired.

While the non-uniform fields 38 being provided between the belt means 15 and 20 of this invention are illustrated as each having its more intense portion directed upwardly, it is to be understood that the conductive layers 28 and 34 could be so constructed and arranged that the more intense portions could point downwardly or could be in any desired pattern of pointing upwardly and downwardly for the desired purposes. Likewise, the electrostatic fields 52 between the belt means 15 and 41 of this invention could through the proper arrangement of the conductive sheet 28 and 48 be provided with the more intense portions thereof pointing upwardly rather than downwardly as illustrated or any combination of patterns that point up and down for the desired purpose.

Further, while the belt means 15, 20 and 41 have been illustrated as having the conductive parts forming a part thereof, it is to be understood that stationary electrodes could be disposed inside the runs of the respective belt means 15, 20 and 41 to create a field action across the space defined between the cooperating runs thereof as fully provided in the aforementioned patent to Candor et al.

Also, while the fields 38 and 52 have been illustrated and described as being non-uniform fields, it is to be understood that the same could be uniform fields, if desired. Such uniform fields would then produce a non-pattern non-woven sheet in the above manner.

Therefore, it can be seen that this invention not only provides an improved method and apparatus for forming a patterned non-woven sheet, but also this invention provides improved methods and apparatus for making an unpatterned non-woven sheet or the like.

However, while the apparatus and method 14 has been previously described as forming the non-woven mat 39 by originally arranging the fibers in the predetermined patterns 11 and 12, it is believed that the method and apparatus 14 could act on an already formed mat wherein the fibers are non-patterned and not permanently secured together to rearrange the fibers thereof into the patterned areas 11 and 12 as the same passes between the belts 15 and 24 through the action of the fields 38 and the moisture of such rearranged mat would be removed therefrom by the electro-osmotic action of the fields 38 and the fields 52 as the rearranged mat passes between the belts 15 and 41. Thus, it is believed that by appropriately charging certain already existing structure disclosed in the aforementioned patent to Kalwaites and similar patents of Kalwaites, the fibers of the material disclosed therein could be rearranged electrostatically with or without the rearranging fluid jets disclosed in such patent or patents.

Also, if it is found that it is desirable to have the conductive parts 28 and 34 of the upper and lower belts 15 and 20 in electrical contact with the slurry therebetween as in the patent to Stiles, the conductive sheet 28 could have the openings 29 thereof filled with insulating material so that the fibers would only be attracted to the unperforated parts thereof to produce the patterned mat 39 previously described.

While the form and method of this invention now preferred have been described as required by the Patent Statute, it is to be understood that other forms and methods can be utilized and still come within the scope of the appended claims.

What is claimed is:

1. A method of making a patterned non-woven sheet comprising the steps of providing a slurry of fluid and fibers, forming said slurry into sheet-like form, and creating an electrostatic field action that acts on said sheet-like form and causes said fibers to be arranged into a predetermined pattern.

2. A method as set forth in claim 1 wherein said step of creating said electrostatic field action comprises the step of disposing a charged patterned electrode means adjacent said sheet-like form.

3. A method as set forth in claim 2 wherein said step of creating said electrostatic field action comprises the step of disposing said charged patterned electrode means against one side of said sheet-like form.

4. A method as set forth in claim 3 wherein said step of creating said electrostatic field action comprises the step of disposing an electrically insulating face of said charged patterned electrode means against one side of said sheet-like form so that the charged part of said electrode means is out of electrical contact with said sheet-like form.

5. A method as set forth in claim 2 wherein said step of creating said electrostatic field action comprises the step of disposing another electrode means adjacent said sheet-like form whereby said electrostatic field action is created between said electrode means.

6. A method as set forth in claim 5 wherein said step of creating said electrostatic field action comprises the steps of disposing said charged patterned electrode means against one side of said sheet-like form and disposing said other electrode means against the other side of said sheet-like form.

7. A method as set forth in claim 6 wherein said step of creating said electrostatic field action comprises the step of respectively disposing electrically insulating faces of said electrode means against said sides of said sheet-like form so that the conductive parts of said electrode means are out of electrical contact with said sheet-like form.

8. A method as set forth in claim 5 and including the step of passing said sheet-like form between said electrode means to have said electrostatic field action act thereon.

9. A method as set forth in claim 8 and including the steps of forming said electrode means in continuous looped belt means with adjacent runs thereof providing said electrostatic field action therebetween, said step of forming said slurry into sheet-like form comprising the step of flowing said slurry between said adjacent runs of said belt means, and moving said belt means so that the adjacent runs thereof move in the same direction and generally at the same speed whereby said sheet-like form moves therewith between said adjacent runs thereof.

10. A method as set forth in claim 9 and including the step of using at least one of said belt means to thereafter electro-osmotically remove liquid from the thus patterned sheet-like form.

11. An apparatus for making a patterned non-woven sheet comprising means for supplying a slurry of fluid and fibers, means for forming said slurry into sheet-like form, and means for creating an electrostatic field action to act on said sheet-like form and cause said fibers thereof to be arranged into a predetermined pattern.

12. An apparatus as set forth in claim 11 wherein said means for creating said electrostatic field action comprises a charged patterned electrode means disposed adjacent said sheet-like form.

13. An apparatus as set forth in claim 12 wherein said charged patterned electrode means is disposed against one side of said sheet-like form.

14. An apparatus as set forth in claim 13 wherein said electrode means has an electrically insulating face disposed against one side of said sheet-like form so that a charged part of said electrode means is out of electrical contact with said sheet-like form.

15. An apparatus as set forth in claim 12 wherein said means for creating said electrostatic field action comprises another electrode means disposed adjacent said sheet-like form whereby said electrostatic field action is created between said electrode means.

16. An apparatus as set forth in claim 15 wherein said charged patterned electrode means is disposed against one side of said sheet-like form and said other electrode means is disposed against the other side of said sheet-like form.

17. An apparatus as set forth in claim 16 wherein said electrode means respectively have electrically insulating faces disposed against said sides of said sheet-like form so that conductive parts of said electrode means are out of electrical contact with said sheet-like form.

18. An apparatus as set forth in claim 15 and including means for passing said sheet-like form between said electrode means to have said electrostatic field action act thereon.

19. An apparatus as set forth in claim 18 wherein said electrode means are formed in continuous looped belt means with adjacent runs thereof providing said electrostatic field action therebetween, said means for passing comprising means for flowing said slurry between said adjacent runs of said belt means, and means for moving said belt means so that the adjacent runs thereof move in the same direction and generally at the same speed whereby said sheet-like form moves therewith between said adjacent runs thereof.

20. An apparatus as set forth in claim 19 wherein at least one of said belt means is utilized to thereafter electro-osmotically remove liquid from the thus patterned sheet-like form.

* * * * *